United States Patent [19]

Goad

[11] Patent Number: 4,624,311

[45] Date of Patent: Nov. 25, 1986

[54] LOCKING MECHANISM FOR HYDRAULIC RUNNING TOOL FOR WELL HANGERS AND THE LIKE

[75] Inventor: Bobby F. Goad, San Antonio, Tex.

[73] Assignee: Baker Oil Tools, Inc., Orange, Calif.

[21] Appl. No.: 780,447

[22] Filed: Sep. 26, 1985

[51] Int. Cl.[4] ..... E21B 23/02

[52] U.S. Cl. ..... 166/125; 166/208; 166/212

[58] Field of Search ..... 166/120, 136, 125, 208, 166/212, 214

[56] References Cited

U.S. PATENT DOCUMENTS

| | | | |
|---|---|---|---|
| 2,916,092 | 12/1959 | Burns | 166/208 |
| 3,152,643 | 10/1964 | Burns | 166/208 |
| 3,677,341 | 7/1972 | Burn et al. | 166/208 |
| 4,287,949 | 9/1981 | Lindsey, Jr. | 166/208 |
| 4,393,931 | 7/1983 | Muse et al. | 166/212 |
| 4,497,367 | 2/1985 | Stevenson | 166/208 |

*Primary Examiner*—Stephen J. Novosad
*Assistant Examiner*—William P. Neuder
*Attorney, Agent, or Firm*—Norvell & Associates

[57] ABSTRACT

A running tool for a hydraulically set packer, hanger, or the like, having expandable slip elements held in a retracted position by an actuating sleeve during run-in, employs an annular piston to hold the actuating sleeve in a fixed locked position relative to the tubular body portion of the running tool, thus preventing inadvertent setting of the tool due to impacts received during the run-in of the tool. When the slips are positioned at their desired location in the well, an increase in fluid pressure applied to the tubular body portion of the running tool will effect an upward movement of the annular piston, shearing a shear screw which has held the piston during the run-in operation, releasing a positive lock engaged with the slip actuating sleeve, and effecting upward movement of the actuating sleeve to release the slips. A contractible ring is also moved by the piston and effects the locking of the actuating sleeve in an upward position after the slips are released, thus eliminating the possibility of the slips being unset by inadvertent downward movement of the actuating sleeve.

5 Claims, 10 Drawing Figures

LOCKING MECHANISM FOR HYDRAULIC RUNNING TOOL FOR WELL HANGERS AND THE LIKE

BACKGROUND OF THE INVENTION

1. Field of the Invention:

The invention relates to a running-in tool for effecting the setting of a subterranean well hanger or packer in which accidental setting of the slips during run-in is prevented by the incorporation of a positive locking mechanism in the hydraulic running tool which maintains the actuating mechanism for the slips in a positively locked position until fluid pressure is applied to a piston element incorporated in the running tool.

2. History of the Prior Art:

It is a common practice in the completion of subterranean wells to effect the hydraulic setting of a packer or hanger within the well casing by expansion of slips into engagement with the casing bore. As exemplified by the disclosure of the U.S. Pat. No. 4,393,931 to MUSE et al, it is common practice to provide in the hydraulic running tool, an annular piston, which is actuated by fluid pressure when the slips of the packer or hanger are disposed in the proper position within the well casing, to shift an actuating sleeve to release the slips into biting engagement with the casing wall. As disclosed in the aforesaid MUSE et al patent, premature release of the slips was prevented through the utilization of one or more shear screws which effected a rigid securement of the actuating piston to the body of the hydraulic running tool. This system of locking the piston has, however, proven unsatisfactory in numerous occasions due to the fact that the shear screws can be inadvertently sheared by impact received on the actuating mechanism for the slips as the hanger or packer is run into the well on the hydraulic running tool. There is, therefore, a definite need for a positive locking mechanism for effecting the securement of the slip actuating sleeve of a hanger, packer, or like device, in a position holding the slips in an inoperative position until the slips are properly positioned in the well.

SUMMARY OF THE INVENTION

A hydraulic running tool embodying this invention employs a tubular body upon which is concentrically mounted a slip actuating or setting sleeve which holds a plurality of spring pressed slips in a radially retracted, inoperative position. The slip actuating sleeve is normally held in a fixed axial position with respect to the tubular body by a radially shiftable locking mechanism. The locking mechanism is held in a radially outward locking position through engagement with an end portion of an annular piston mounted in a fluid pressure chamber defined between the actuating or setting sleeve and the tubular body of the hydraulic running tool. The piston is secured in its retention position with respect to the locking machanism by a shear screw connection to the actuating sleeve; however, any impact blows received on the actuating mechanism during running-in are not imparted to the shear screw but are absorbed by the locking mechanism. The piston is otherwise free to move axially with respect to the tubular body of the hydraulic running tool.

Upon positioning of the retracted slips of the packer or hanger at the desired location in the subterranean well, fluid pressure is introduced through the bore of the tubular body and transmitted by radial ports to the fluid pressure chamber containing the annular locking piston. Such fluid pressure is effective to move the piston and effect the shearing of the shear screw securing the piston to the actuating sleeve. Further axial movement of the piston effects the complete removal of an end portion of the piston from engagement with the locking element, permitting such locking element to be cammed inwardly by relative axial movement of the setting sleeve produced by the subsequent engagement of the other end portion of the piston with an internally projecting shoulder providing on the setting sleeve. The positive lock of the setting sleeve is therefore removed and the setting sleeve can be moved axially by the piston sufficiently to permit the spring-pressed slips to advance into biting engagement with the casing wall.

Near the end of the fluid pressure produced axial movement of the annular piston, a contractible C-ring carried by the piston drops into a recess or reduced diameter portion of the exterior of the tubular body. When the annular piston is moved downwardly by gravity or any fluid pressure differential produced after the discontinuance of the fluid pressure on its lower end, the anchored C-ring engages a downwardly facing internal shoulder on the upper portions of the actuating sleeve and thus prevents any return movement of the actuating sleeve sufficient to re-contact the slips. Thus, the hydraulic running tool can then be removed from the set hanger or packer through the normal releasable coupling provided by a left-hand-threaded connection to the body of the hanger or packer, and the entire running tool, including the aforedescribed piston and locking mechanism can be removed from the well.

Further advantages of the invention will be readily apparent to those skilled in the art from the following detailed description, taken in conjunction with the annexed sheets of drawings, upon which is shown a preferred embodiment of the invention.

DESCRIPTION OF THE PREFERRED EMBODIMENT

Figure 1A:
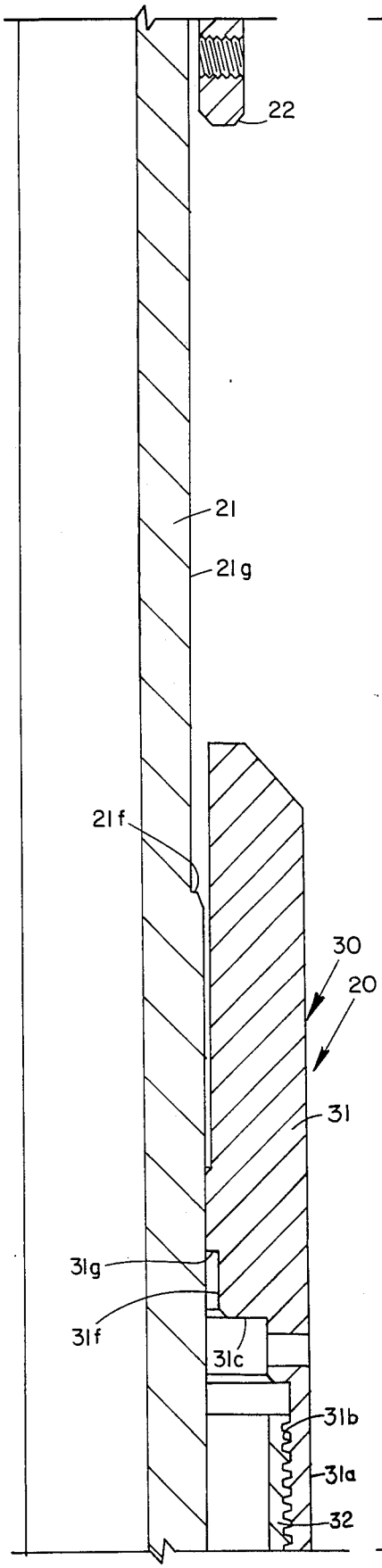
FIGS. 1A, 1B, and 1C collectively represent a vertical quarter sectional view of a hydraulic running tool for a packer or the like embodying the locking mechanism of this invention, with the elements thereof shown in their run-in position.

The principles of this invention can obviously be applied to a variety of different types of well tools incorporating radially movable slip elements for effecting a rigid engagement with the interior wall of a well casing or conduit. The application of the invention specifically shown in the drawings is to a hanger of the type generally shown in the aforementioned MUSE et al U.S. Pat. No. 4,393,931. As used hereinafter, the term "hanger" is intended to incorporate any form of hanger, packer, bridge plug, or the like wherein radially shiftable slip elements are employed which must be run into the well in a retracted position and then released to effect a biting engagement with the adjacent wall of the well conduit.

Figure 4:
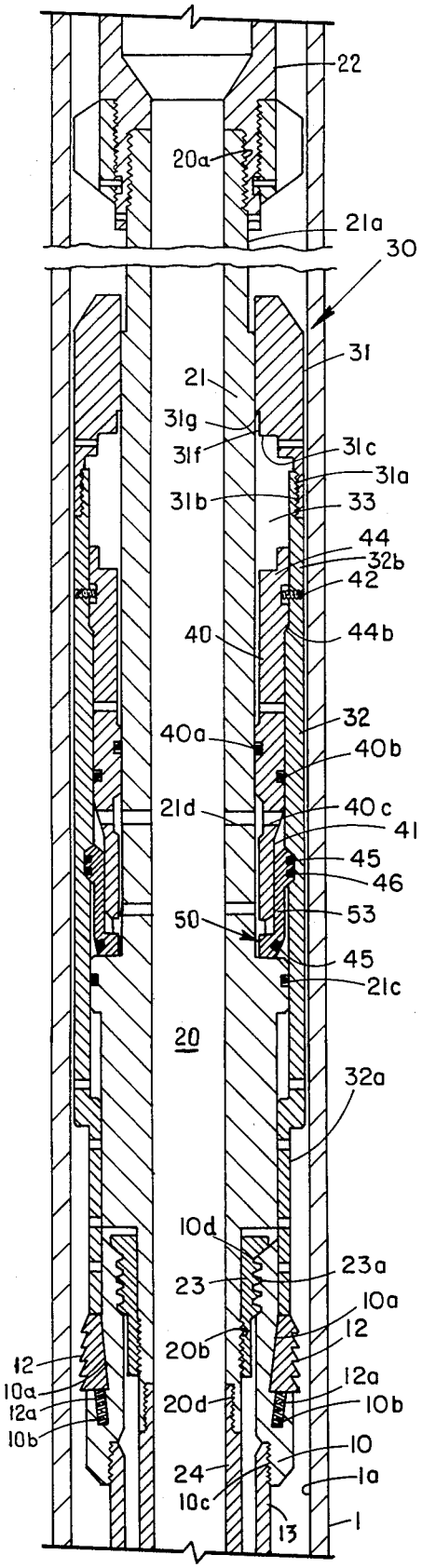
FIG. 4 is a schematic vertical sectional view of a hanger secured to the hydraulic running tool of FIGS. 1A, 1B, and 1C.

Thus, one type of hanger, similar to that described and illustrated in the aforementioned MUSE et al patent, is shown schematically in FIG. 4 of the drawings with the modifications of this invention. Such hanger comprises a hollow body portion 10 having appropriate axially extending camming slots 10*a* formed in the exterior walls thereof to mount a plurality of peripherally spaced slip elements 12. Springs 12*a* are respectively mounted in apertures 10*b* in the hollow housing portion 10 to provide a generally radially directed bias to the slip elements 12 to urge them into biting engagement with the adjacent wall of a well casing 1. The extreme bottom portion of the hollow housing 10 is internally threaded as indicated at 10*c* to provide a mounting for a suspended tubing string 13. The upper portion of hollow housing 10 is provided with conventional internal left-handed threads 10*d* to provide a detachable connection to the running tool 20 embodying this invention. An actuating or setting sleeve 30 is fixedly mounted to the periphery of the running tool 20 and, in the run-in position, has a bottom portion 32*a* engaging the upper ends of the slips 12 to hold such slips in a radially retracted inoperative position, as shown in FIG. 4.

The running tool 20 comprises a main tubular body portion 21 which is provided at its upper end with threads 20*a* for connection to a sub 22 by which a connection is made to the bottom end of a tubular work string (not shown). The tubular body portion 21 is further provided with external threads 20*b* at its lower end for mounting a sleeve 23 having external left-hand threads 23*a* for engagement with the internal left-hand threads 10*d* of the hanger body portion 10. The extreme bottom portion of the tubular body 20 is provided with internal threads 20*d* for mounting an extension sleeve 24 thereto to permit the mounting of any additional desired tools on the running tool.

Figure 1B:
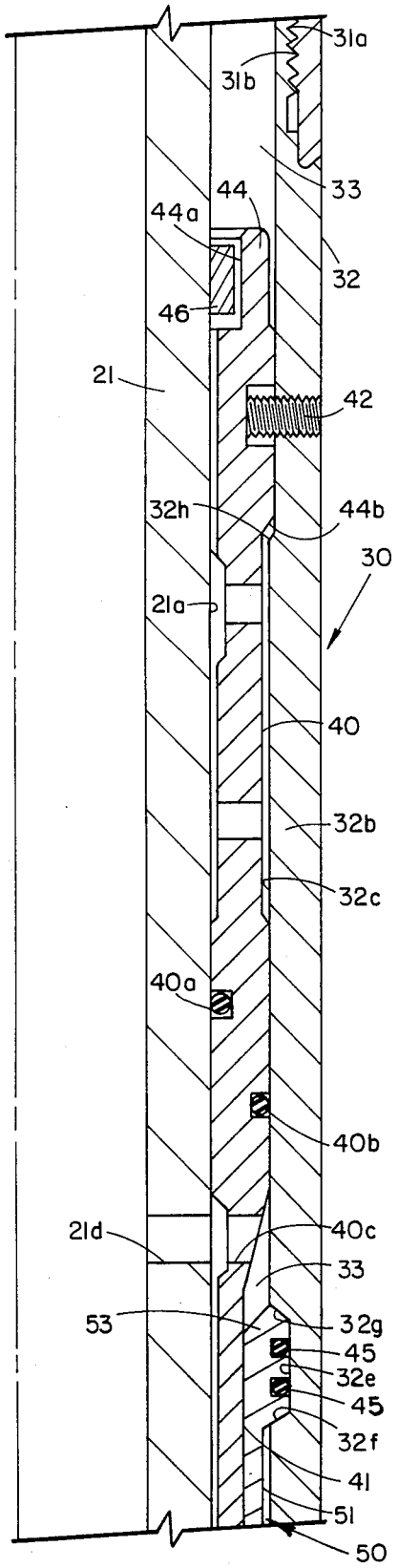
Figure 1C:
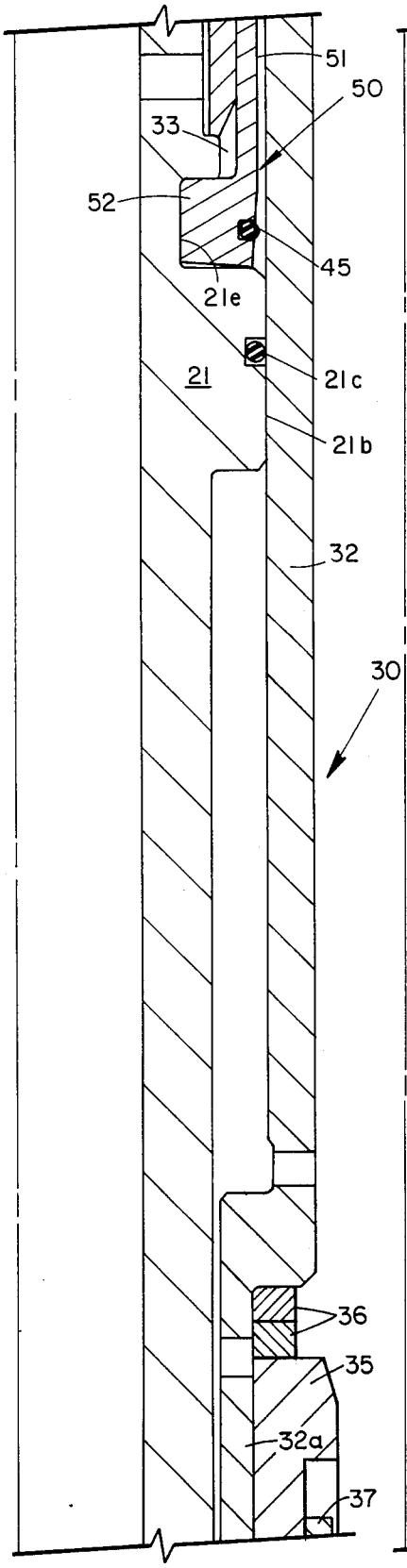

Referring now to the enlarged scale views of FIGS. 1A, 1B, and 1C, it will be noted that the actuating or setting sleeve 30 is a tubular assembly with an upper portion 31 mounted in surrounding relationship to the upper tubular body portion 21. The lower end 31*a* of upper portion 31 is threadably secured by threads 31*b* to a downwardly extending thin-walled sleeve portion 32. Sleeve portion 32 extends downwardly and is engaged in sliding and sealing relationship with an annular radial projection 21*b* (FIG. 1C) formed on the tubular body portion 21. An O-ring seal 21*c* seals this sliding connection.

Below the O-ring seal 21*c* the sleeve portion 32 terminates in a radially smaller diameter portion 32*a* which mounts in a conventional finger rings 35 below two bearing ring 36. A C-ring 35*a* holds finger ring 35 in position. Downwardly extending fingers 37 are secured to finger ring 35 by screws 37*a* (FIG. 2C) and respectively extend into abutting relationship with the upper ends of the slips 12 to hold the slips in retracted position. Thus, to effect the release of the slips 12, a substantial upward movement of the actuating sleeve 30 must be produced to permit the spring-pressed slips 12 to move axially and radially into biting engagement with the conduit wall 1*a*.

The upper portion 32*b* of the actuating sleeve 30 thus defines an annular fluid pressure chamber 33 between the interior bore 32*c* of the upper sleeve portion 32*b* of the actuating sleeve 30 and the exterior cylindrical surface 21*a* of the tubular body portion 21 above the annular radial projection 21*b*. An annular piston 40 is mounted in the annular fluid pressure chamber 33 and, in its run-in position, the piston 40 is secured by one or more shear screws 42 to the sleeve portion 32 of the slip actuating sleeve 30. The medial portion of the piston 40 is provided with O-ring seals 40*a* and 40*b* respectively engaging the external periphery 21*a* of the tubular body portion 21 and the internal bore surface 32*c* of the sleeve portion 32 of the slip actuating sleeve 30. In this position, one or more radial ports 21*d* in body portion 21 are aligned with ports 40*c* provided in the piston 40 below the seals 40*a* and 40*b*. Thus, the application of fluid pressure to the bore of the running tool will produce an upward force on the piston 40, which force can be utilized to effect the shearing of shear pins 42 and permit piston 40 to shift axially upwardly relative to the tubular body portion 21.

In the run-in position illustrated in FIGS. 1B and 1C, a lower reduced thickness portion 41 of piston 40 underlies the upper portions 51 of a peripherally segmented lock 50. Each segment of lock 50 has a bottom head portion 52 which is mounted in an annular recess 21*e* formed in the tubular body portion 21 at a position immediately above the radially enlarged shoulder 21*b*. The upper portions 51 of segmented lock 50 terminate in outwardly enlarged head portions 53 which are engagable in an annular recess 32*e* formed in the sleeve portion 32 and having inclined end walls 32*f* and 32*g*. Thus, so long as the piston portion 41 underlies the upper lock portions 51, the actuating sleeve 30 is rigidly locked to the tubular body portion 21 and no release movement of the slips 12 can be produced by any impact suffered by the running-in tool during the well insertion operation. Resilent retaining bands 45 encircle the enlarged portions of lock 50 and hold the lock segments in assembly.

Figure 2A:
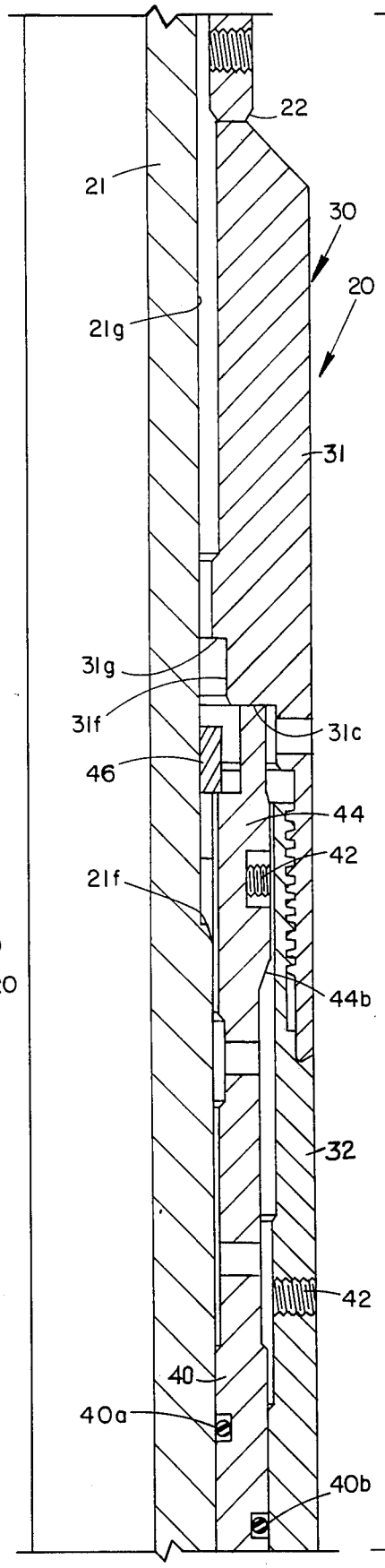
FIGS. 2A, 2B, and 2C are views respectively similar to FIGS. 1A, 1B, and 1C, but illustrate the position of the elements of the locking mechanism after the application of fluid pressure to the locking piston.
Figure 2B:
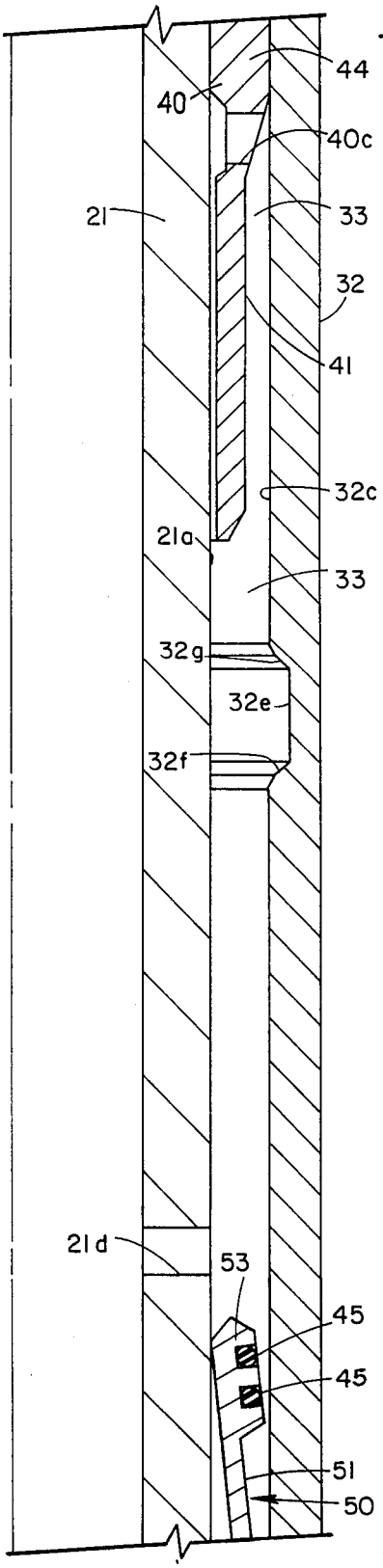
Figure 2C:
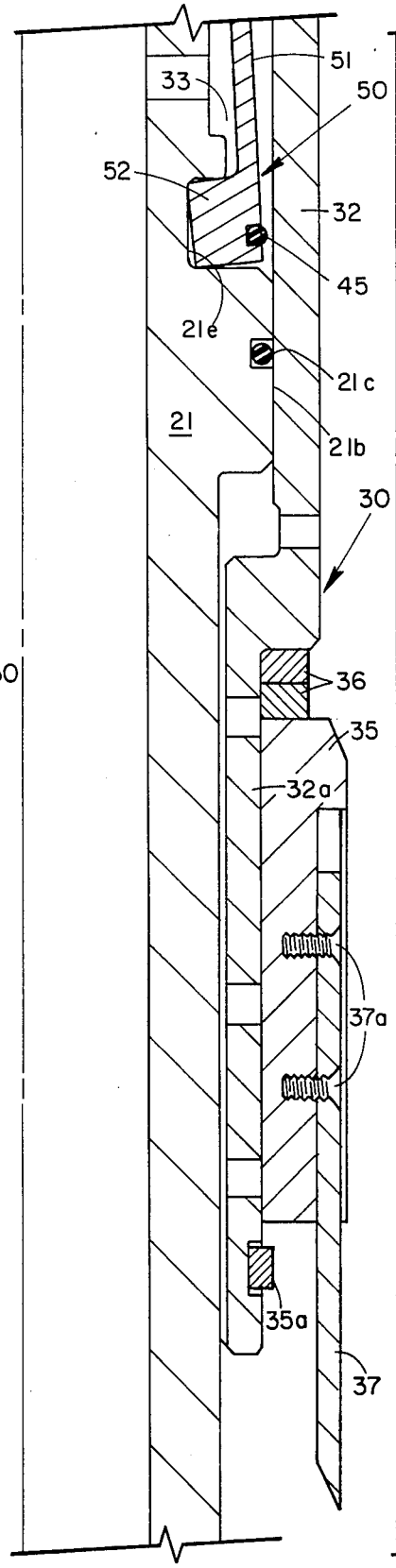
Figure 3C:
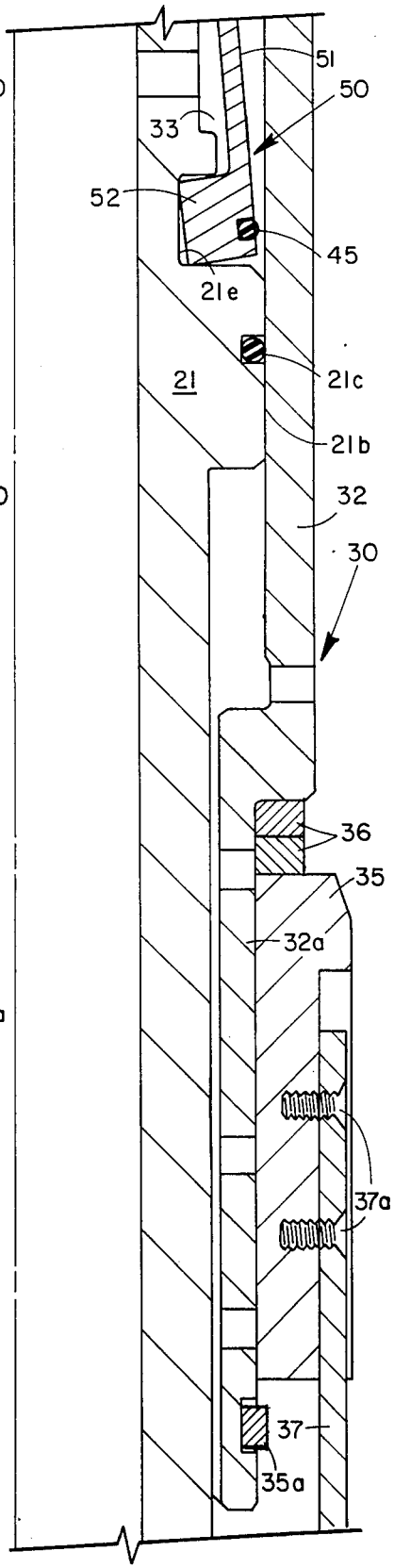

When the slips 12 are positioned in the well at the desired location, fluid pressure is then provided through the tubular work string and into the bore of the tubular body 21. Such fluid pressure acts on the piston 40 to move it upwardly and effect the shearing of shear screws 42. As illustrated in FIGS. 2A, 2B, and 2C, such upward movement of the piston 40 first removes the small diameter retaining portion 41 of piston 40 from its abutting position relative to the upper lock portions 51 and permits such lock portions 51 and the enlarged head portions 53 to move inwardly, thus freeing the actuating sleeve 30 for movement relative to the tubular body portion 21. Such movement is produced by the top end 44 of piston 40 abutting the downwardly facing shoulder 31*c* formed at the juncture of the enlarged upper portion 31 of the actuating sleeve 30 and actuating sleeve 30 is moved upwardly a sufficient distance to insure the setting of the slips 12 of the hanger 10.

The upper end portion 44 of the annular piston 40 is provided at its top end with a counter bore 44*a*. A contractible C-ring 46 is mounted in this counter bore end and in the run-in position of the apparatus, snugly surrounds the periphery of the body portion 21. The body portion 21 is, however, reduced at the extreme upper end as indicated by the upwardly facing shoulder 21*f* and, when the contractible C-ring 46 overrides the shoulder 21*f*, it snaps into engagement with the reduced diameter upper portion 21*g* of the tubular body 21. In this position, C-ring 46 is of sufficiently large diameter to engage the upper end 31*g* of the downwardly facing counter bore 31*f* provided on the upper portion 31 of the actuating sleeve 30. Thus the actuating sleeve 30 is effectively locked against returning downwardly to a position where it can engage the slips 12, as shown in FIG. 3A.

Figure 3A:
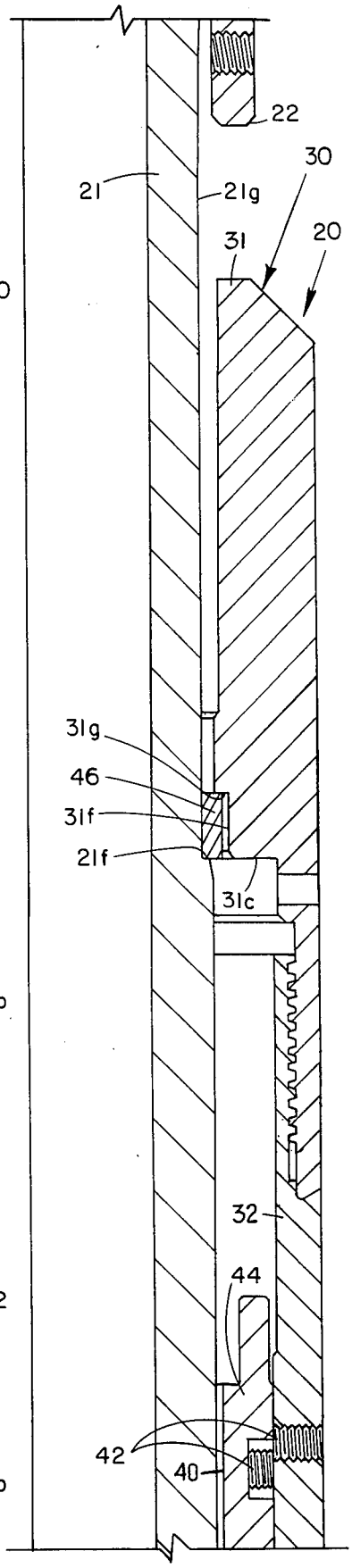
FIGS. 3A, 3B, and 3C are views respectively similar to FIGS. 1A, 1B, and 1C, but illustrate the position of the elements after the removal of fluid pressure from the locking piston.
Figure 3B:
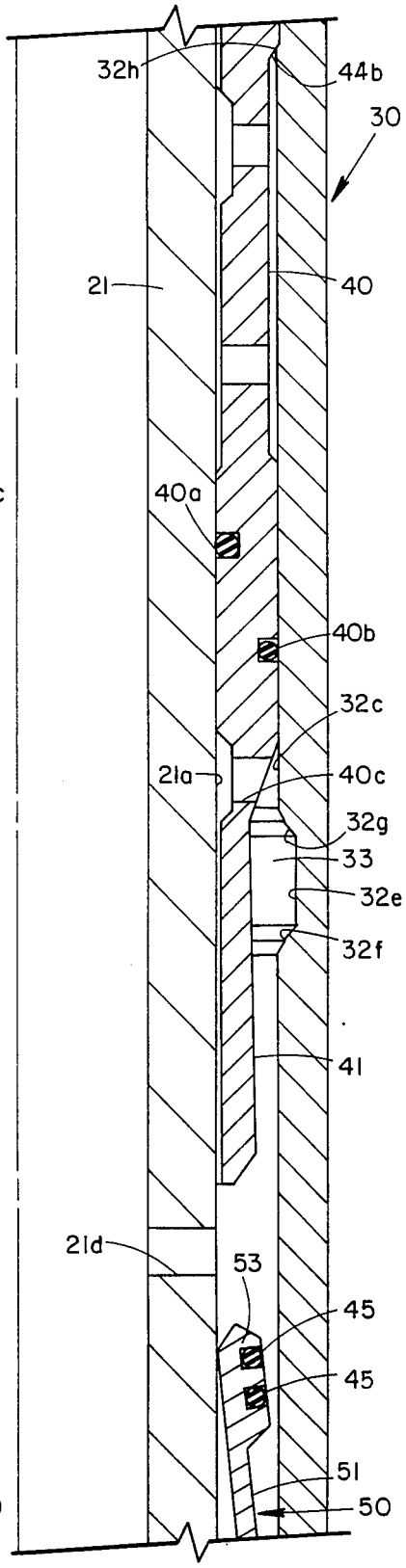

After setting of the slips 12, the internal fluid pressure applied through the bore of the work string can be released and the piston 40 may drift downwardly a limited distance as indicated in FIGS. 3A and 3B due to any downwardly acting fluid pressure differential that may exist or due to just the weight of the piston. The downward movement of the piston 40 is, however, limited by the downwardly facing inclined shoulder 44*b* provided on the upper portion 44 of the piston 40 which engages the correspondingly shaped upwardly facing shoulder 32*h* formed on the sleeve portion 32 of the slip actuating sleeve 30. Thus, the downward movement of the piston 40 is positively stopped prior to any contact of the bottom end portion 41 of the piston with segmented lock 50.

It is therefore apparent that this invention provides a positive locking of the slip actuating sleeve of a fluid pressure actuated running tool for a hanger. The locking is effected in a positive manner and cannot be disturbed during run-in by impacts suffered by the running tool. Moreover, the application of a fluid pressure to the bore of the tool will effect the release of an annular piston which is driven upwardly to effect the release of the locking elements, and then effect the upward movement of the slip actuating sleeve to permit the slips to move outwardly into biting engagement with the conduit wall. Lastly, any downward movement of the actuating sleeve or the piston after release of the fluid pressure is positively prevented through the action of a contractible C-ring which effects a lock between the actuating sleeve and the body portion of the running tool against any downward movement of the actuating sleeve. A shoulder on the actuating sleeve also prevents any substantial downward movement of the annular piston so as to prevent interference with the locking segments. Upon achieving the setting of the slips in the manner described, the entire running tool can be readily released from the set hanger by right-hand rotation of the tubular work string, and the running tool may be removed from the well and repeatedly utilized for the running-in of other hangers, with the only requirement being the replacement of the shear screws which hold the annular piston in its initial run-in position.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A running tool for installing a hanger in a subterranean well conduit, said hanger having a hollow housing and spring-pressed, radially shiftable slip elements mounted on the exterior of said hollow housing, comprising: a tubular body portion attachable to a tubing string; means for detachably connecting said tubular body portion to said hollow housing; an actuating sleeve axially slidably mounted on said body portion and operatively engagable in one axial position with said hanger slip elements to secure same in a radially retracted position for run-in; radially shiftable locking means disposed between said actuating sleeve and said tubular body portion to secure said actuating sleeve in said one axial position when said locking means is in its radially outer position; an annular piston axially slidably mounted on said tubular body portion in an annular fluid pressure chamber defined between said actuating sleeve and said tubular body portion; said piston having a portion holding said locking means in said radially outer position when said piston is in said one axial position; shearable means securing said piston in said one axial position of said piston for run-in purposes; and means for supplying fluid pressure to said annular fluid pressure chamber to axially move said piston to shear said shearable means, release said locking means and to axially shift said actuating sleeve by said piston from said one axial position of said actuating sleeve to release said slip elements for movement into engagement with the conduit bore.

2. A running tool in accordance with claim 1 further comprising locking means for preventing return of said actuating sleeve to said one position after release of said slip elements.

3. A running tool in accordance with claim 2 wherein said locking means comprises a contractible C-ring mounted on said tubular body portion for axial movement by said annular piston to a position on said tubular body preventing return movement of said actuating sleeve.

4. A running tool in accordance with claim 1 wherein said locking means comprises a peripherally segmented lock having enlarged head portions at each end respectively engagable with annular recesses formed in said tubular body portion and said actuating sleeve.

5. A running tool in accordance with claim 1 further comprising means urging said radially shiftable locking means to a radially inward position.

* * * * *